US010543858B2

(12) United States Patent
Coseglia

(10) Patent No.: US 10,543,858 B2
(45) Date of Patent: Jan. 28, 2020

(54) RAILWAY CAR TRUCK WITH FRICTION SHOES

(71) Applicant: Amsted Rail Company, Inc., Chicago, IL (US)

(72) Inventor: John Coseglia, Edwardsville, IL (US)

(73) Assignee: AMSTED RAIL COMPANY, INC., Chicago, IL (US)

( * ) Notice: Subject to any disclaimer, the term of this patent is extended or adjusted under 35 U.S.C. 154(b) by 223 days.

(21) Appl. No.: 15/463,739

(22) Filed: Mar. 20, 2017

(65) Prior Publication Data

US 2018/0265101 A1 Sep. 20, 2018

(51) Int. Cl.
*B61F 5/12* (2006.01)
*B61F 5/16* (2006.01)

(52) U.S. Cl.
CPC ..... *B61F 5/122* (2013.01); *B61F 5/16* (2013.01)

(58) Field of Classification Search
CPC ..... B61F 5/122; B61F 5/16
See application file for complete search history.

(56) References Cited

U.S. PATENT DOCUMENTS

| | | | | |
|---|---|---|---|---|
| 3,559,589 | A | 2/1971 | Williams | |
| 3,834,320 | A | 9/1974 | Tack | |
| 4,084,514 | A | 4/1978 | Bullock | |
| 4,109,585 | A | 8/1978 | Brose | |
| 4,254,713 | A | 3/1981 | Clafford | |
| 4,274,340 | A | 6/1981 | Neumann et al. | |
| 4,915,031 | A * | 4/1990 | Wiebe | B61F 5/122 105/198.2 |
| 5,086,708 | A * | 2/1992 | McKeown, Jr. | B61F 5/122 105/198.2 |
| 5,095,823 | A * | 3/1992 | McKeown, Jr. | B61F 5/122 105/198.2 |
| 8,136,456 | B2 | 3/2012 | Sammartino | |
| 2002/0073880 | A1 * | 6/2002 | Wronkiewicz | B61F 5/122 105/182.1 |
| 2004/0261652 | A1 * | 12/2004 | Berg | B61F 5/122 105/182.1 |
| 2006/0137565 | A1 | 6/2006 | Forbes | |

(Continued)

FOREIGN PATENT DOCUMENTS

| | | | |
|---|---|---|---|
| RU | 111085 | U1 | 12/2011 |
| RU | 157747 | U1 | 12/2015 |
| WO | 2011019579 | A2 | 2/2011 |

OTHER PUBLICATIONS

Office Action in corresponding Canadian Application No. 2,995,941, dated Jan. 17, 2019, 5 pages.

(Continued)

*Primary Examiner* — Jason C Smith
(74) *Attorney, Agent, or Firm* — Amsted Industries Incorporated

(57) ABSTRACT

A friction shoe is provided for use in a railway truck. The friction shoe is placed such that it frictionally engages both a wear plate on the side frame vertical column and wear plates on the slope surfaces of the bolster to dampen the oscillating motion of the bolster when supported by spring groups in the side frame. The shoe is provided with sloped surfaces that engage complementary slope surfaces on the bolster. Wear plates are fitted and held on the sloped surfaces of the bolster and on the vertical columns of the side frames.

14 Claims, 3 Drawing Sheets

(56) References Cited

U.S. PATENT DOCUMENTS

| | | | | |
|---|---|---|---|---|
| 2008/0127853 | A1 | 6/2008 | Forbes | |
| 2015/0367866 | A1 | 12/2015 | Yin et al. | |
| 2018/0257675 | A1* | 9/2018 | Coseglia | B61F 5/122 |
| 2018/0257676 | A1* | 9/2018 | Coseglia | B61F 5/122 |
| 2018/0257677 | A1* | 9/2018 | Coseglia | B61F 5/122 |
| 2018/0265101 | A1* | 9/2018 | Coseglia | B61F 5/16 |

OTHER PUBLICATIONS

Office Action in corresponding Russian Application No. 2018109282, dated Oct. 2, 2018, 9 pages.
Office Action in corresponding Australian Application No. 2018201928, dated May 1, 2019, 6 pages.

* cited by examiner

RAILWAY CAR TRUCK WITH FRICTION SHOES

BACKGROUND AND SUMMARY OF THE INVENTION

The present invention relates to railway freight car trucks and more particularly, to three piece railway freight car trucks comprised of two parallel side frames with a transverse bolster extending there between. The bolster has two ends each of which is supported by a spring group in a central opening in each side frame. The present invention further relates to an arrangement to dampen the oscillating motion of the bolster in the railway truck.

More particularly, the invention relates to a friction shoe having two spaced sloped surfaces. Each bolster end has two spaced sloped surfaces that engage the spaced sloped surfaces on each friction shoe. Each bolster end sloped surface includes a wear plate that is affixed to the bolster sloped surface by bolts or other connecting devices that allow the wear plate to be replaced.

In one embodiment of the invention, the bolster sloped surfaces have two surfaces forming an angle of 150 to 178 degrees relative to each other. In another embodiment of the invention, the bolster sloped surfaces are a single flat surface.

The type of railway car truck to which the present invention relates comprises two spaced side frame members each having an opening arranged to support opposite ends of a bolster. Each friction shoe also includes a vertical face that engages a complementary vertical face on the side frame having a vertical wear plate. The vertical wear plate is affixed to the side frame vertical face by bolts or other connecting devices that allow the vertical wear plate to be replaced.

It is an object of the present invention to provide an arrangement with a friction shoe for dampening the oscillating motion of a bolster in a railway truck.

It is a further object of the present invention to provide an arrangement for dampening the oscillating motion of a bolster in a railway truck by the use of a wear plate that is affixed to the bolster sloped surface to allow the wear plate to be readily replaced.

DESCRIPTION OF THE PREFERRED EMBODIMENT

Figure 1:
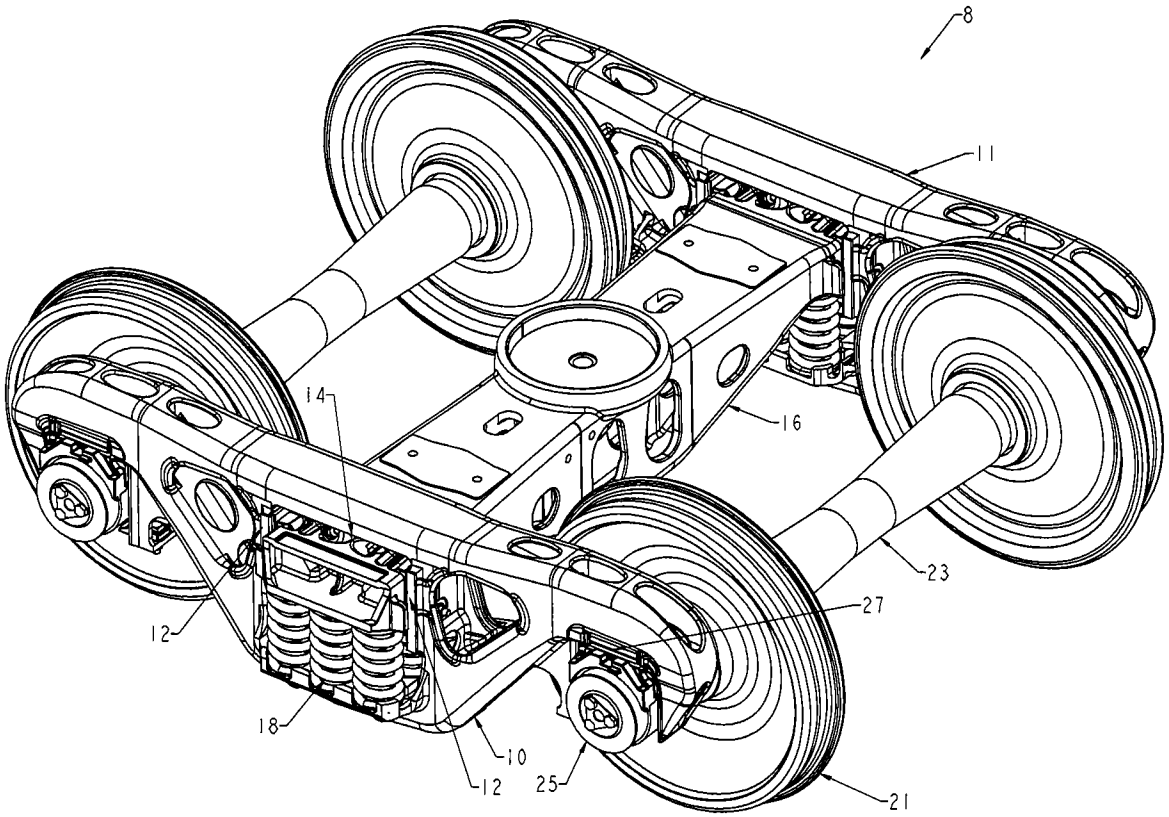
FIG. 1 is a isometric view of a railway car truck in accordance with an embodiment of the present invention.
Figure 2:
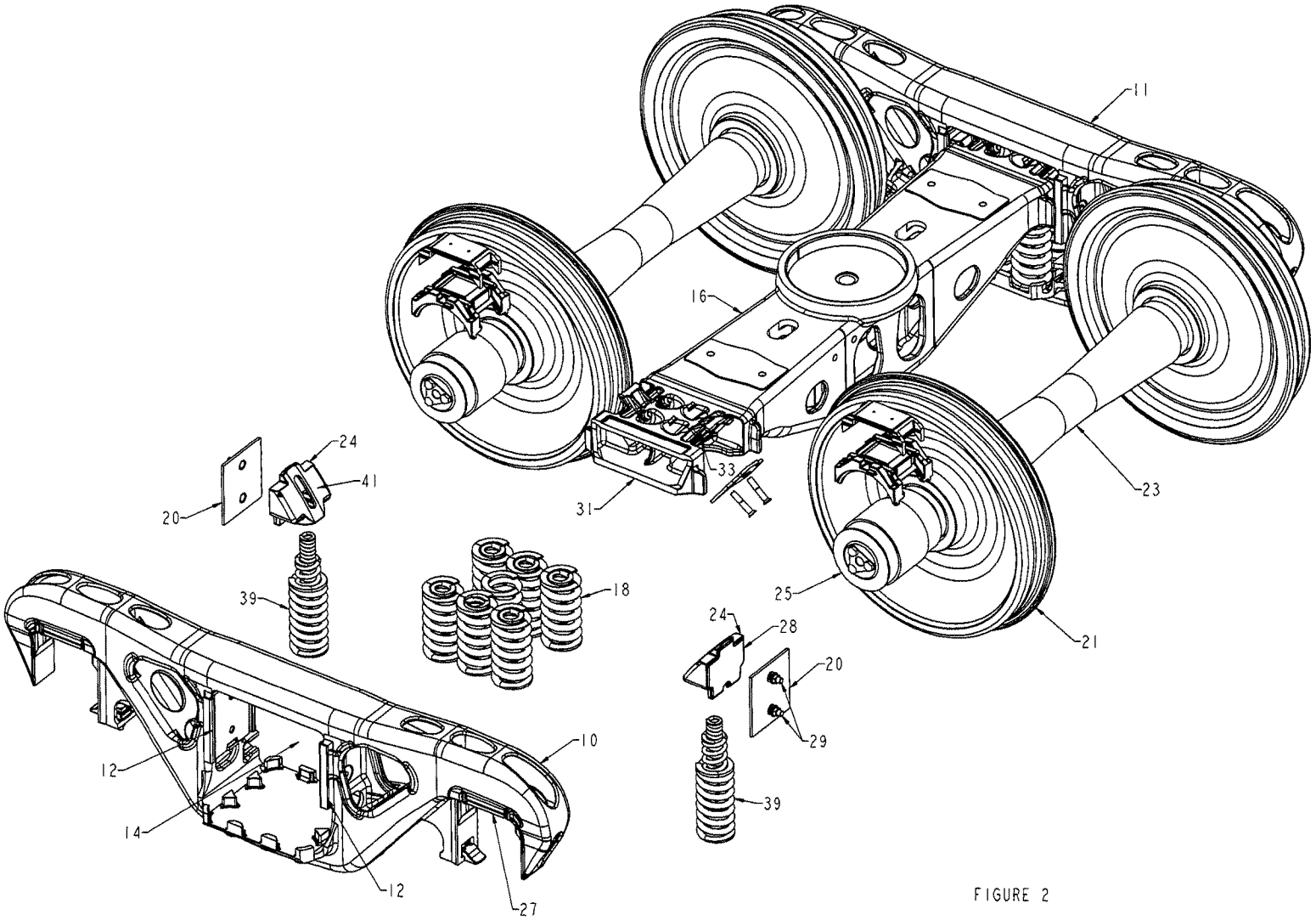
FIG. 2 is a isometric component view of a railway car truck in accordance with an embodiment of the present invention.

In FIGS. 1 and 2 there is shown a railway car truck 8 with side frames 10 and 11 having a pair of vertical columns 12 defining the sides of a bolster opening 14 formed in side frame 10 with a similar opening in side frame 11. One end of a bolster 16 is resiliently supported by spring group 18 in the bolster opening 14. Side frames 10 and 11 and bolster 16 are usually comprised of a cast steel, unitary structure.

Wheels 21 are mounted onto the journal area of axles 23. Axle roller bearings 25 are affixed to the ends of axle 23 and support the side frame 10 in pedestal area 27.

As shown in FIG. 2, bolster 16 has two ends 31, each of which includes 2 or more sloped support surfaces 33. Friction shoe 24 includes a vertical surface 28 which frictionally engages side frame column friction plate 20. Friction shoe 24 also comprises sloped surfaces 41 which extend at an acute angle with regard to vertical surface 28. Side frame column friction plate 20 is affixed to side frame column 12 by bolts 29 or other suitable fastening devices. Friction shoe 24 is urged into frictional engagement with side frame column friction plate 20 and sloped surface 33 of bolster 16 by a suspension control spring group 39. Spring group 39 urges sloped surfaces 41 of friction shoe 24 into engagement with wear plate 43 which is affixed to sloped surface 33 of bolster 16. Wear plate 43 is usually a unitary structure made from cast iron, cast, steel or forged, or fabricated steel or low friction polymer.

Figure 3:
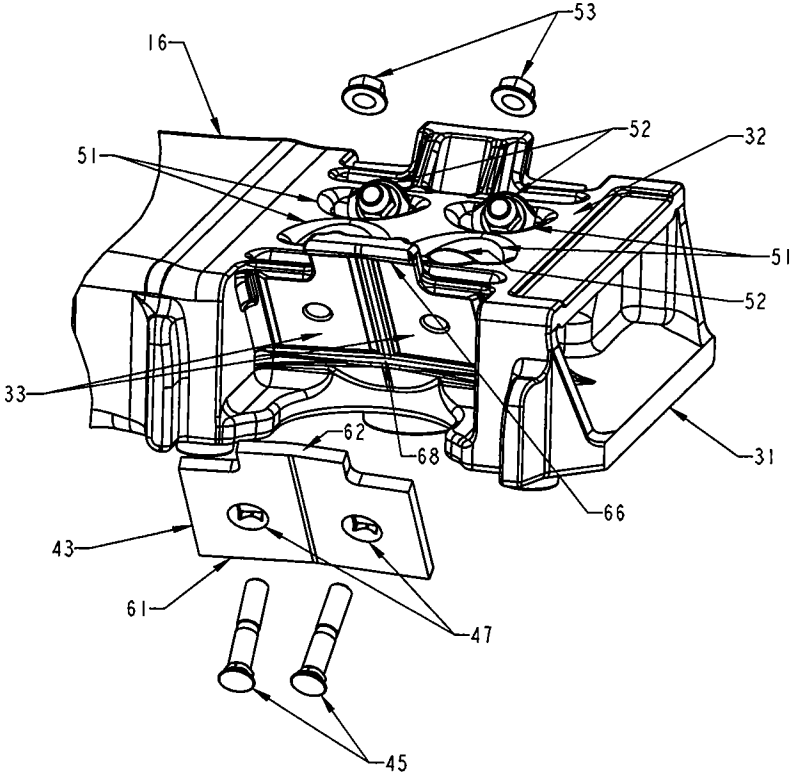
FIG. 3 is a partial detailed isometric exploded view of railway car truck bolster end and friction shoe in accordance with an embodiment of the present invention.

As shown in FIG. 3, in the preferred embodiment of the invention, Wear plate 43 is usually a unitary structure made from cast, forged, or fabricated steel or low friction polymer. Wear plate 43 includes a top surface 62 that fits adjacent to a top lip 66 of sloped surface 33 of bolster 16. Wear plate 43 also includes a bottom surface 61 that fits adjacent to a bottom lip 68 of sloped surface 33 of bolster 16. Wear plate 43 includes two holes 47 through which bolts 45 pass. The bolts pass thru the sloped wall 33, and the top horizontal wall 32 of the bolster end 31. The top horizontal wall 32 includes raised bosses 51 above depressions 52 to permit the installation of nuts 53 on the ends of bolts 45. The depressions 52 allow ready access to the nuts 53 with a standard wrench. The bolts 45 and nuts 53 allow replacement of wear plates 43 without cutting or welding. Depressions 52 allow ready access by a normal wrench to install and tighten nuts 53 to the end of bolts 45. Bolts 45 are specially selected as to strength and dimension to properly hold wear plate 43 on bolster sloped surface 33. Bolts 45 are usually made of hardened steel, with usual dimensions of 19 mm or 0.75 inch diameter and 102 mm in length. This allows about 64 mm of length to be in tension to provide strong support for wear plate 43.

Wear plate 43 in this embodiment is comprised of two faces at angles of about 150 to 178 degrees relative to each other, but may also be a single flat surface.

What is claimed is:

1. A railway car truck comprising:

a side frame having an upright column partially defining a center opening, wherein the upright column includes a vertical surface;

a bolster having sloped surfaces and a bolster end supported in the side frame center opening for vertical movement therein, wherein the bolster end includes a top surface having a depression opening;

a first wear plate attached to the vertical surface on the upright column;

a second wear plate attached to the sloped surfaces of the bolster;

a friction shoe including a vertical wall and two sloped surfaces extending at an acute angle with the vertical wall;

a spring urging the friction shoe sloped surfaces into engagement with the first wear plate on the side frame column and with the second wear plate on sloped surfaces of the bolster; and bolts affixing the second wear plate to the sloped surfaces on the bolster, wherein ends of the bolts extend through the depression opening in the bolster end.

2. The railway car truck of claim 1, wherein the second wear plate includes two planar surfaces at an angle of 150-178 degrees relative to each other.

3. The railway car truck of claim 1, wherein the sloped surfaces of the bolster include a top lip and a bottom lip, and the second wear plate includes a top surface that is fitted adjacent to the top lip and a bottom surface that is fitted adjacent to the bottom lip.

4. The railway car truck of claim 1, wherein the top surface of the bolster includes raised bosses adjacent the depression opening.

5. The railway car truck of claim 1, wherein a portion of the top surface of the bolster is contoured to provide a seating surface for a nut to be applied to the end of the bolts which fasten the slope surfaces to the second wear plate as well as provide a wrench clearance for the nut.

6. The railway car truck of claim 1, wherein the second wear plate has bolt holes that are countersunk with square thru holes for use with plow head bolts or countersunk with round holes for use with flat head bolts.

7. A railway car truck comprising:

a side frame having an upright column partially defining a center opening, wherein the upright column includes a vertical surface;

a bolster having sloped surfaces and a bolster end supported in the side frame center opening for vertical movement therein, wherein the bolster end includes a top surface having one or more depressions;

a first wear plate attached to the vertical surface on the upright column, two second wear plates, wherein each of the two second wear plates is attached to a respective one of the sloped surfaces of the bolster;

a friction shoe comprising a vertical wall and two sloped surfaces extending at an acute angle with the vertical wall;

one or more springs urging the sloped surfaces into engagement with the first wear plate on the upright column and with the second wear plates on the sloped surfaces of the bolster; and bolts affixing the two second wear plate to the sloped surfaces on the bolster, wherein ends of the bolts extend through the one or more depressions in the bolster end.

8. The railway car truck of claim 7, wherein each of the two second wear plates is comprised of a single flat surface.

9. The railway car truck of claim 7, wherein the sloped surfaces of the bolster include one or more top lips and one or more bottom lips, and each of the two second wear plates includes a top surface that is fitted adjacent to the one or more top lips of the sloped surface of the bolster and a bottom surface that is fitted adjacent to the one or more bottom lips of the sloped surface of the bolster.

10. The railway car truck of claim 7, wherein the one or more depressions allow a nut to be applied to the end of each of the bolts by use of a wrench.

11. The railway car truck of claim 7, wherein a portion of the top surface of the bolster is contoured to provide a seating surface for a nut to be applied to the end of the bolts which fasten the slope surfaces to one or both of the two second wear plates as well as provide a wrench clearance for the nut.

12. The railway car truck of claim 7, wherein one or both of the second wear plates has bolt holes that are countersunk with square thru holes for use with plow head bolts or countersunk with round holes for use with flat head bolts.

13. A railway car truck comprising:

a side frame having an upright column partially defining a center opening, wherein the upright column includes a vertical surface;

a bolster having sloped surfaces and a bolster end supported in the side frame center opening for vertical movement therein;

a first wear plate attached to the vertical surface on the upright column;

a second wear plate attached to the sloped surfaces of the bolster, wherein the second wear includes bolt holes that are countersunk with square thru holes for use with plow head bolts or countersunk with round holes for use with flat head bolts;

a friction shoe including a vertical wall and two sloped surfaces extending at an acute angle with the vertical wall; and a spring urging the friction shoe sloped surfaces into engagement with the first wear plate on the side frame column and with the second wear plate on sloped surfaces of the bolster.

14. A railway car truck comprising:

a side frame having an upright column partially defining a center opening, wherein the upright column includes a vertical surface;

a bolster having sloped surfaces and a bolster end supported in the side frame center opening for vertical movement therein;

a first wear plate attached to the vertical surface on the upright column, two second wear plates, wherein each of the two second wear plates is attached to a respective one of the sloped surfaces of the bolster, wherein each of the two second wear plates includes bolt holes that are countersunk with square thru holes for use with plow head bolts or countersunk with round holes for use with flat head bolts;

a friction shoe comprising a vertical wall and two sloped surfaces extending at an acute angle with the vertical wall; and one or more springs urging the sloped surfaces into engagement with the first wear plate on the upright column and with the two second wear plates on the sloped surfaces of the bolster.

* * * * *